US005864306A

United States Patent [19]

Dwyer et al.

[11] Patent Number: 5,864,306

[45] Date of Patent: Jan. 26, 1999

[54] DETECTION REGIONS FOR TRANSPONDER TRACKING

[75] Inventors: Douglas Dwyer, Brea; Stephen J. Feitelson, Corona; Robert H. Kramp, II, Fullerton; Patrick P. Lim, Hacienda Heights, all of Calif.

[73] Assignee: Raytheon Company, Lexington, Mass.

[21] Appl. No.: 785,184

[22] Filed: Jan. 17, 1997

[51] Int. Cl.[6] ..... G08G 1/00

[52] U.S. Cl. ..... 340/928; 340/933; 340/937; 340/825.31

[58] Field of Search ..... 340/928, 933, 340/937, 942, 825.31, 825.34, 825.08, 825.54; 235/380, 384; 701/223; 342/442, 456

[56] References Cited

U.S. PATENT DOCUMENTS

| | | | |
|---|---|---|---|
| 5,101,200 | 3/1992 | Swett | 340/937 |
| 5,283,573 | 2/1994 | Takatou et al. | 340/937 |
| 5,406,275 | 4/1995 | Hassett et al. | 340/933 |
| 5,640,156 | 6/1997 | Okuda et al. | 340/928 |
| 5,686,906 | 11/1997 | Ono et al. | 340/928 |
| 5,710,556 | 1/1998 | Nishimura et al. | 340/928 |

*Primary Examiner*—Jeffery A. Hofsass
*Assistant Examiner*—Van T. Trieu
*Attorney, Agent, or Firm*—Georgann S. Grunebach

[57] ABSTRACT

Data transmissions between a transponder and a reader of a toll collection system are minimized while the transponder moves through a communication zone of the system. A plurality of dimensionally programmable detection regions, are defined within the communication zone. Detection criteria are also defined that indicate whether the transponder transitions into, out of, or both into and out of one of a plurality of "in" detection regions. Then it is determined if the current geolocation of the transponder is within any of the detection regions. The current location of the transponder is compared to the previous location of the transponder. If a change in the location of the transponder occurs and one of the detection criteria has been met, a detection region report message is generated. The detection region report message is sent to an application processor for processing, and if the transponder moves out of any of the "in" detection regions, the application processor drops the communications link to that transponder. This minimizes the amount of processing and data transfer between the transponders and the reader and processor.

3 Claims, 4 Drawing Sheets

DETECTION REGIONS FOR TRANSPONDER TRACKING

BACKGROUND

The present invention relates generally to transponder communications systems, and more particularly, to a method that controls the systematic exchange of data between a transponder in a vehicle and a reader by processing data transmissions in a plurality of detection regions that cover less than the entire tracking zone to minimize the amount of data transferred therebetween.

The assignee of the present invention has developed an open road toll road revenue collection system that computes tolls for vehicles using a toll road. A vehicle-to-roadside communications (VRC) system is used to exchange data between transponders in vehicles and a reader. The VRC system is an over-the-air, line-of-sight two way communication system. The VRC system transfers data from a memory of the transponder to a roadside reader and from the reader to the memory of the transponder. The reader continuously outputs frame messages in a predetermined radio frequency (RF) band.

Toll collection sites are set up at entry and exit ramps of the toll road. When the transponder moves within a communications zone of a toll collection site, it detects the transmitted reader frame messages, wakes up and attempts to decode the message. When the reader frame message is decoded correctly, the transponder is connected to the system, and transmits its transponder ID code. The reader then assigns a time slot in a message frame in which the transponder transmits its memory contents.

A transponder locator listens to radio frequency transmissions from the transponder. The transponder locator uses multiple antennas with phase array elements to determine the angle of arrival of the transmitted RF signals at each antenna. These angle of arrival measurements are combined and the geolocation of the transponder is determined. Measurements made at different times and at multiple transponder locations are processed to determine a track on the road of the path of the transponder.

The communication zone in which transponders can communicate with the reader cannot be configured such that the reader only communicates with transponders in a certain area. The communication zone is larger than the toll collection site. Consequently, the reader has the ability to communicate with transponders that are not exiting or entering the toll road. This increases the processing required by both the reader and the locator.

Prior to the present invention, the transponder locator generated position data every time a transponder ID code was correctly received while the transponder was in the communication zone. The raw data was then processed by a processor to make a positional graph. Thus, the locating scheme used prior to the present invention had the transponder locator continuously report the position of a transponder to the processor and display system when the transponder was in the communication zone.

The disadvantage of this approach was that the transponder locator sent data to the processor every 10 milliseconds to update the position of the transponder. Prior to the present invention, the transponder locator could have been required to send over 200 messages for the same vehicle while it was passing through the communications zone. The reader communicates with multiple transponders, and the transponder locator tracks multiple transponders. In a situation with many transponders communicating with the transponder locator, the transponder locator was required to output more than 30,000 bits of information per second. It was determined that a reduction in the amount of data transferred by the transponder locator without impairing system performance would be a benefit.

Thus, it is an objective of the present invention to provide for a method that minimizes data transfer between the transponder locator and processor. It is a further objective of the present to provide a method wherein detection regions are used to determine entry into the toll zone and to determine that a transponder and its vehicle is on a different road and whose data should be discarded.

SUMMARY OF THE INVENTION

To meet the above and other objectives, the present invention defines regions of interest within the tracking zone that may be programmed into a transponder locator and which are used to track the transponders. Transponders that are detected outside these regions of interest are not identified to the processor. Use of these regions of interest also allow the transponder locator to be configured for use at different locations, or toll collection sites.

In accordance with the present method, a plurality of dimensionally programmable detection regions are defined within a communication zone. Detection criteria are also defined that indicate whether the transponder transitions into or out of one of the detection regions. Then it is determined if the current geolocation of the transponder is within any of the "in" detection regions. The current location of the transponder is compared to the previous location of the transponder. If a change in the location of the transponder occurs and one of the detection criteria has been met, a detection region report message is generated.

The present method allows the processor to map toll collection sites to different regions of interest. Each region may be sized in terms of variable X and Y coordinates. The variably sized regions of interest are programmed to report transponder activity. The present invention provides for region definitions and the types of processes that are performed when a transponder enters or exist a particular region. This feature allows the transponder locator to only report on transponders passing through the regions of interest to the processor. Data transmissions are reduced by eliminating reports for transponders that are outside the regions of interest where information generated by the transponder locator is meaningless to the processor.

The detection regions or regions of interest may be defined so that certain subareas of the communication zone correspond to a toll collection zone. The collection process is initiated when the transponder enters the toll collection zone defined by the region of interest, also known an "in regions". Regions may also be defined in areas of the communication zone where a vehicle (transponder) is definitely not going to exit or enter the toll road, which are referred to as "out regions". When the transponder is detected in one of these regions, the transponder locator alerts the processor that the transponder is not of interest and the processor drops the communications link to that transponder. This reduces the processing load on the reader, in that the reader does not have to communicate with transponders that are not actually passing through the toll collection zone to enter or exit the toll road.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
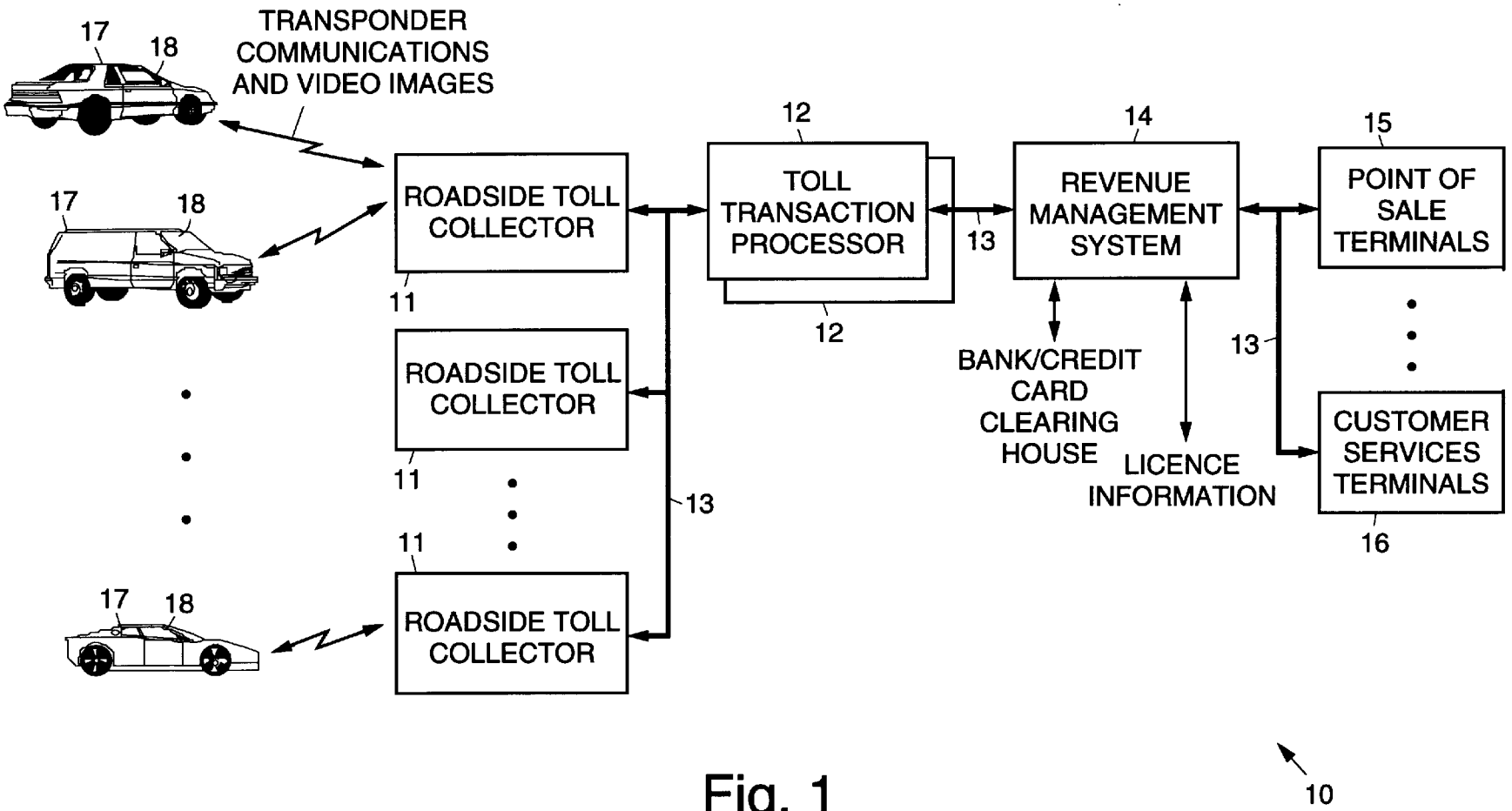
FIG. 1 illustrates a system block diagram of an open road toll collection system in which the present invention is employed.

Referring to the drawing figures, FIG. 1 illustrates an open road toll collection system 10 that employs a sequential messaging method 40 in accordance with the principles of the present invention. The system 10 comprises a plurality of roadside toll collectors 11, or roadside toll collection systems 11, that are coupled by way of a fiber optic network 13 to one and preferably two redundant toll transaction processors 12. The toll transaction processors 12 are coupled by way of the fiber optic network 13 to a revenue management system 14 that interfaces with computers of an appropriate motor vehicle authority to obtain license information regarding vehicles 17, and bank and credit card clearing houses to process bills and receive payments. The revenue management system 14 is coupled by way of the fiber optic network 13 to point of sale terminals 15 and customer service terminals 16.

Figure 2A:
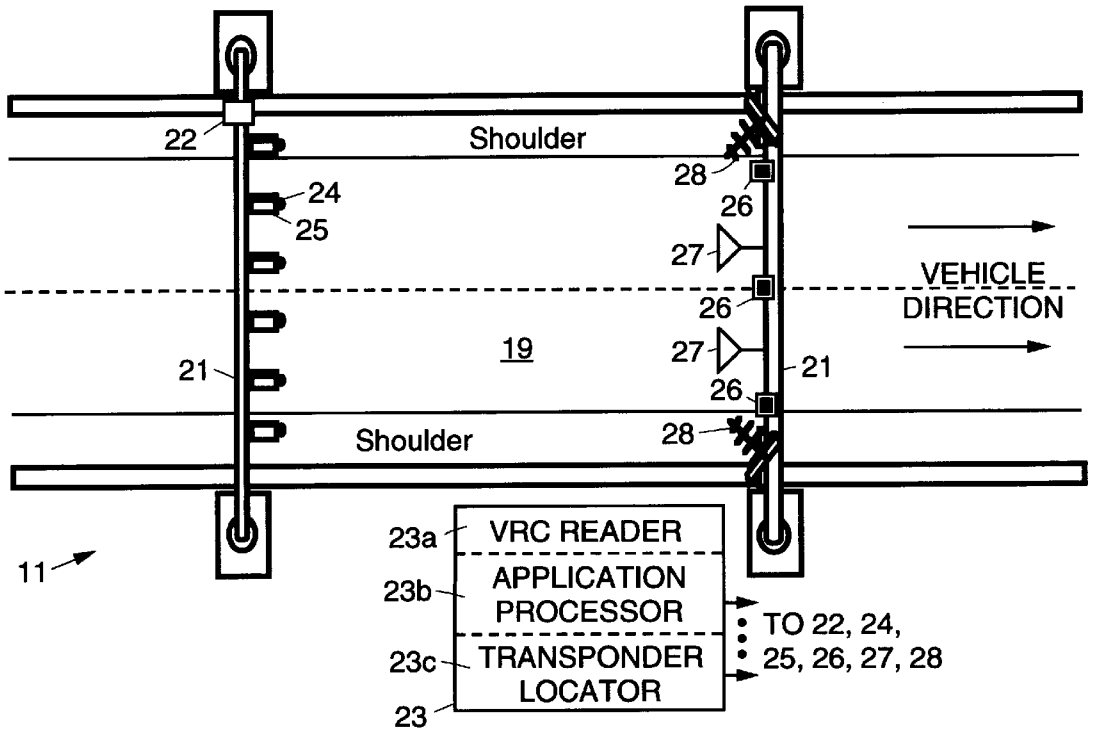
FIGS. 2*a* and 2*b* illustrate top and side views, respectively, of an embodiment of a roadside toll collector employed in the system of FIG. 1.
Figure 2B:
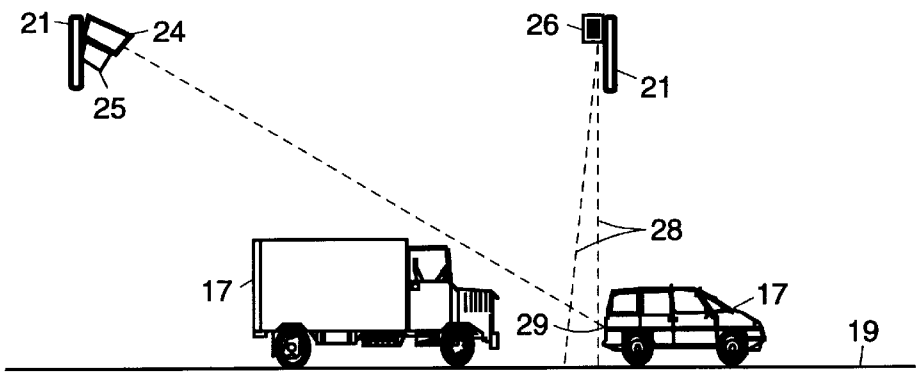

Vehicles 17 may contain windshield-mounted transponders 18 that communicate with individual roadside toll collectors 11 upon entry to and exit from a toll road 19 (FIGS. 2*a* and 2*b*). The vehicles are detected when they enter and exit the toll road 19 which provides data indicative of the locations and times of entry into and exit from the toll road 19. The transponder 18 transmits transponder identification data to the roadside toll collectors 11 that is correlated with the vehicle detection data. The identification data, location data, and entry and exit data are processed by the roadside toll collectors 11 to generate transaction reports for each vehicle 17. The toll transaction processor 12 processes the transaction reports to generate tolling transactions for each vehicle 17. The tolling transactions are forwarded to the revenue management system 14 which generates tolls for each vehicle 17 and bills the owner of the transponders 18 for use of the toll road 19.

However, the present system 10 also permits vehicles 17 that are not equipped with a transponder 18 to also use the toll road 19. Vehicles 17 are detected to determine the time of entry into and exit from (the transaction time) the toll road 19. If no transponder 18 is detected, the system 10 uses license plate cameras 24 to capture images of the license plates 29 of the vehicles 17 (as will be described with reference to FIGS. 2*a* and 2*b*). The images of the license plates 29 are processed using optical character recognition processing to identify the owner of the vehicle. Vehicle ownership data derived from processing the images of the license plates 29 are use to bill registered owners of the vehicles 17.

A more detailed description of the open road toll collection system 10 is provided in copending U.S. patent application Ser. No. 08/785,184, filed Jan. 17, 1997, entitled "An Open Road Cashless Toll Collection System and Method Using Transponders and Cameras to Track Vehicles", assigned to the assignee of the present invention. The contents of this application are incorporated herein by reference.

Referring now to FIGS. 2*a* and 2*b*, they illustrate top and side views, respectively, of an embodiment of the roadside toll collector 11 employed in the system 10 of FIG. 1. Each roadside toll collector 11 has two gantries 21 that span the entry (and exit) lanes of the toll road 19. A plurality of license plate cameras 24 are located on the first gantry 21 that is passed by the vehicles 17 that are used to image the license plates 29 of non-transponder equipped vehicles 17. A plurality of lights 25 are also disposed on the first gantry 21 that are used to illuminate the license plates 29 in low light level conditions. A light sensor 22 may be disposed on the first gantry 21, for example, that is used to monitor the light intensity at the roadside toll collector 11 and provide feedback signals to the roadside toll collector 11 that are used to control shutter, gain, and pedestal settings of the license plate cameras 24 during changing lighting conditions that affect the quality of the imaged license plates 29.

A plurality of vehicle detector and classification (VDAC) systems 26 are disposed on the second gantry 21 along with a plurality of VRC antennas 28 that transmit and receive RF signals that communicate with the transponders 18 in transponder equipped vehicles 17. A plurality of transponder locator antennas 27 is also disposed on the second gantry 21 that are used to locate transponders 18 in the vehicles 17. Each of the vehicle detector and classification systems 26 include a laser-based sensor that generates a dual fan-beam scanning laser beam that is used to determine the speed, height, length and profile of vehicles 17 as they pass a toll collection zone.

A roadside control station 23 is disposed adjacent to the toll road 19 in the vicinity of the gantries 21. The roadside control station 23 comprises a vehicle-roadside communications (VRC) reader 23*a*, an application processor 23*b*, and a transponder locator 23*c*. The VRC reader 23*a*, application processor 23*b*, and transponder locator 23*c* are coupled to each other and transmit data and commands therebetween as required to process transactions within the roadside toll collector 11. The application processor 23*b* is also coupled to the license plate cameras 24, the lights 25, the light sensor 22, and the vehicle detector and classification systems 26. The VRC reader 23*a* is coupled to the VRC antennas 28 and is used to read each identification code (ID) transmitted from the transponders 18 and write data to the transponders 18. The transponder locator 23*c* is coupled to transponder locator antennas 27 which cooperate to locate the transponders when they pass through the toll collection zone.

The vehicle detector and classification system 26 employed in a reduced to practice embodiment of the system 10 is manufactured by Schwartz Electro Optics. The transponder locator 23*c* employed in the system 10 is described in U.S. Pat. No. 5,227,803 assigned to the assignee of the present invention. The transponders 18 each have a unique ID number or ID code assigned to them, which is used for identification purposes. The transponders 18 communicate with the transponder locators using a "slotted aloha" time division multiple access (TDMA) communications protocol that is described in U.S. Pat. Nos. 5,307,349 and 5,425,032, assigned to the assignee of the present invention.

The roadside toll collector 11 comprises a toll collection site that is set up at entry and exit ramps of the toll road 19. When a transponder 18 is within a communications zone of a roadside toll collector 11, it detects the transmitted reader frame messages, wakes up and attempts to decode the message. When the reader frame message is decoded correctly, the transponder 18 is connected to the system 10, and transmits its transponder ID code. The VRC reader 23*a* then assigns a time slot in a message frame in which the transponder 18 transmits its memory contents.

The transponder locator 23*c* listens to radio frequency transmissions from the transponder 18. The transponder locator 23*c* uses multiple antennas 27 with phase array elements to determine the angle of arrival of the transmitted RF signals at each antenna 27. The angle of arrival measurements are combined and the geolocation of the transponder 18 is determined. Measurements made at different times and at multiple transponder locations are processed to determine a track on the road 19 of the path of the transponder 18.

A communication zone 31 (FIG. 3) in which transponders 18 can communicate with the reader cannot be configured such that the VRC reader 23*a* only communicates with transponders 18 in a certain area of the zone 31. The communication zone 31 is larger than the toll collection site. Consequently, the VRC reader 23*a* has the ability to communicate with transponders 18 that are not exiting or entering the toll road 19. The present invention eliminates this problem. The goals of the present invention are to determine whether a vehicle 17 containing a transponder 18 will go through the toll collection zone 31, determine which transponders 18 definitely will not go through the toll collection zone 31, and minimize data transfer between the application processor 23*b* and the transponder locator 23*c*. This is achieve by having the transponder locator 23*c* configured with "in" and "out" zones or regions. Data on a transponder is only transmitted when the transponder 18 enters or exits a zone, or data is requested by the application processor 23*b*.

Figure 3:
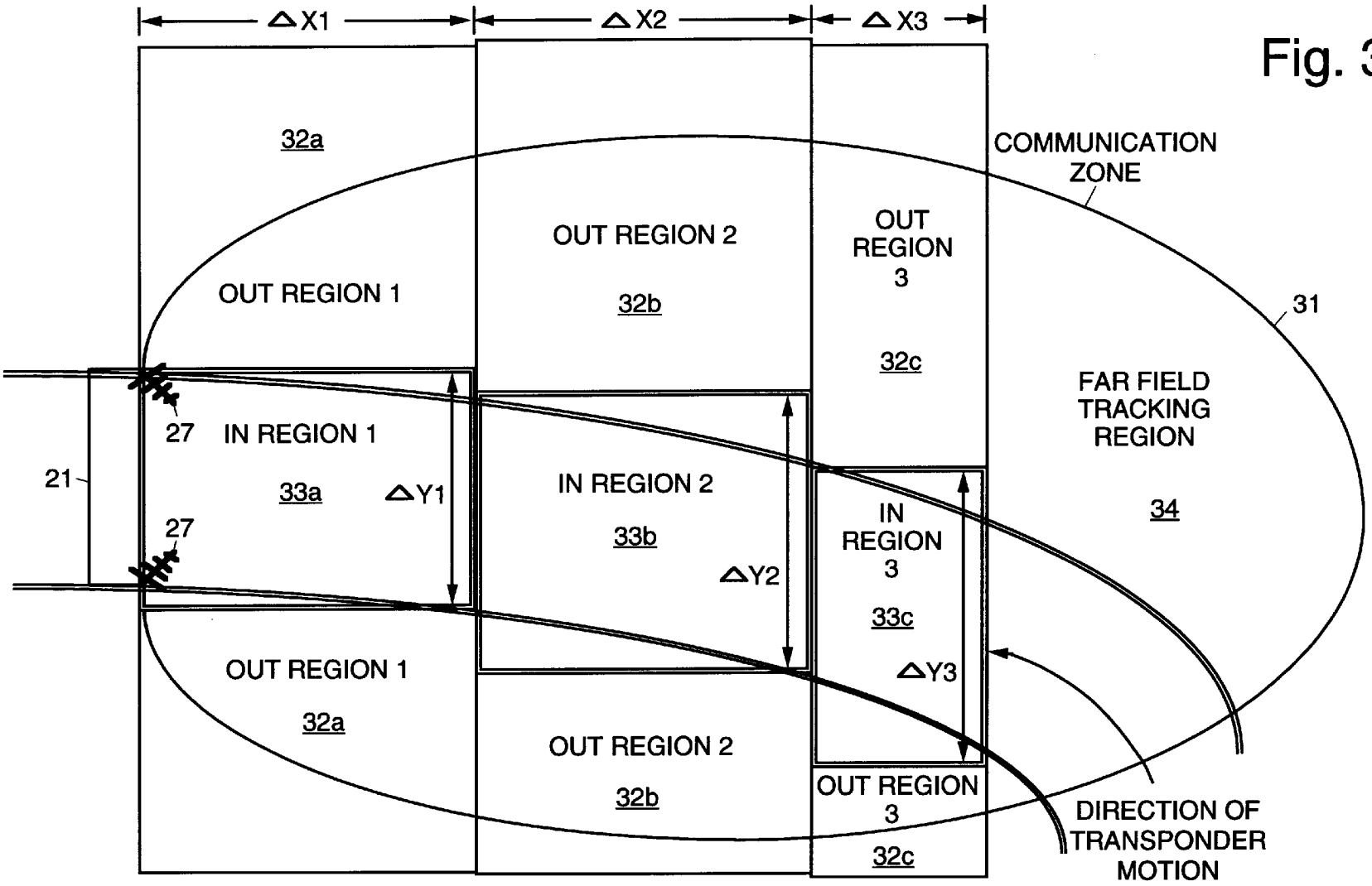
FIG. 3 illustrates a communication zone that is configured to have a plurality of detection regions in accordance with the principles of the present invention that are used to control exchanges of data between a transponder in a vehicle and the reader of the roadside toll collector of FIG. 2.

Referring to FIG. 3, it shows a communication zone 31 configured with a plurality of detection regions 32, 33, 34 in accordance with the principles of the present invention. The plurality of detection regions 32 (32*a*, 32*b*, 32*c*), 33 (33*a*, 33*b*, 33*c*), 34 are used to control exchanges of data between the transponder 17 in a vehicle 18 and the VRC reader 23*a* in the roadside toll collector 11. The detection regions 33*a*, 33*b*, 33*c* are configured as "in" detection regions. The detection regions 32*a*, 32*b*, 32*c* are configured as "out" detection regions. The detection region 34 is configured as a far field tracking region.

Transmissions from transponders 18 within each of the detection regions 32, 33, 34 are processed by the transponder locator 23*c*. Inputs for processing by the transponder locator 23*c* include a current smoothed geolocation of the transponder 18 that meets and bounds of the "in" detection regions 33*a*, 33*b*, 33*c*, and predetermined detection criteria. The detection criteria indicates whether the transponder 18 transitions into, out of, or both into and out of one of the "in" detection regions 33*a*, 33*b*, 33*c* are to be reported.

The processing performed in the transponder locator 23*c* examines the current smoothed geolocation of the specified transponder 18 with respect to the "in" detection regions 33*a*, 33*b*, 33*c*. As shown in FIG. 3, each of the "in" detection regions 33*a*, 33*b*, 33*c* is a rectangular region within the communication zone 31 that is defined with respect to the locator antenna 27. The "in" detection regions 33*a*, 33*b*, 33*c* may overlap one another. Each "in" detection region 33*a*, 33*b*, 33*c* has configurable detection criteria associated with it. That is, each "in" detection region 33*a*, 33*b*, 33*c* is configured such that a report message is generated if the current smoothed geolocation of the specified transponder 18 meets one or more of the detection criteria. Detection criteria include whether the specified transponder 18 has just entered or exited one of the "in" detection regions 33*a*, 33*b*, 33*c*, and whether that transponder 18 is inside or outside the specified "in" detection region 33*a*, 33*b*, 33*c*. The transponder locator 23*c* is programmable to process data from up to eight detection regions.

Figure 4:
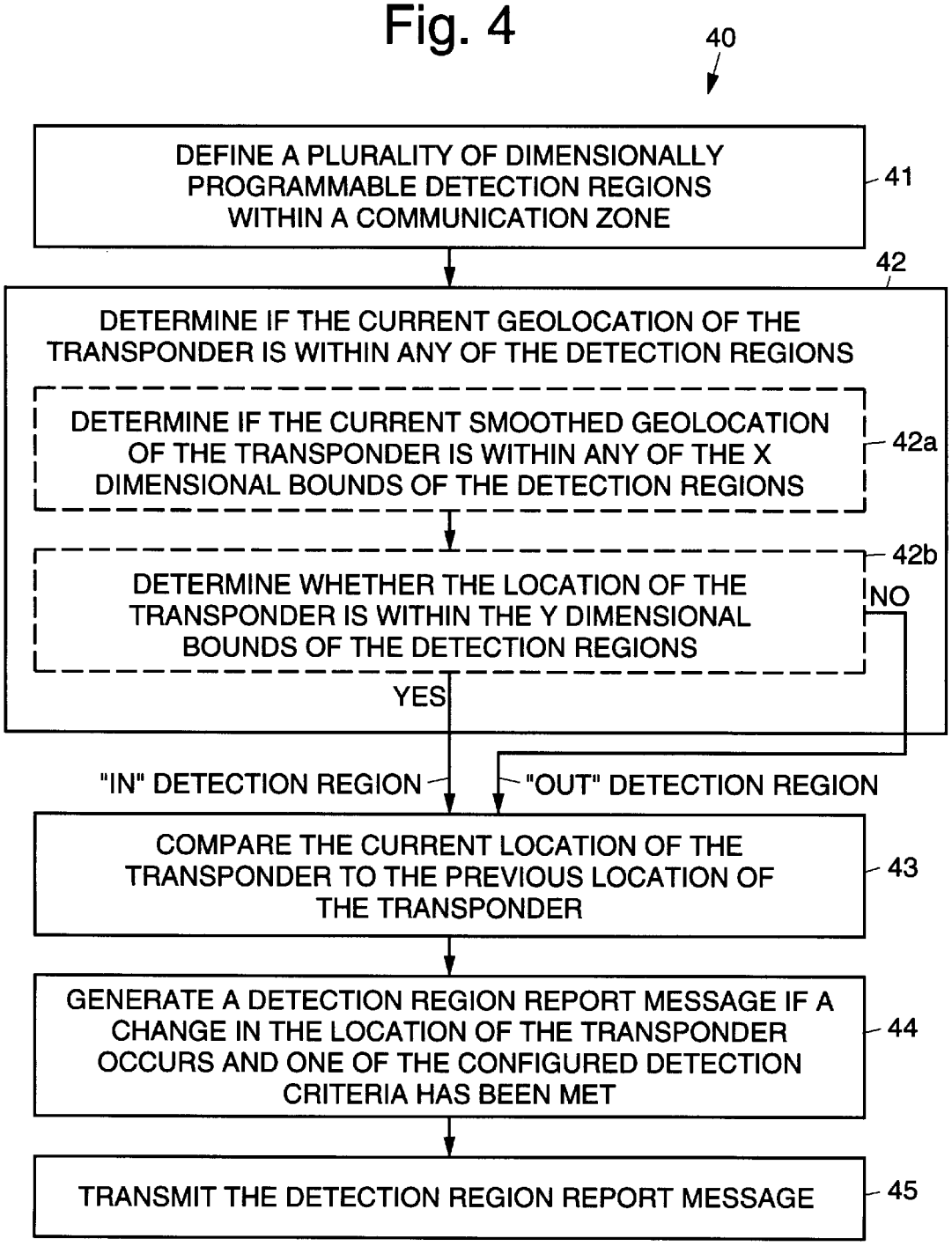
FIG. 4 is a flow chart illustrating the processing that is performed to implement the present invention.

Referring now to FIG. 4, a flow chart illustrating the processing 40 performed in the transponder locator 23*c* that implements the present invention is shown. The processing 40 performed in the transponder locator 23*c* is as follows. A plurality of dimensionally programmable "in" detection regions 33*a*, 33*b*, 33*c* and "out" detection regions 32*a*, 32*b*, 32*c* relative to a communication zone 31 along with detection criteria that indicate whether the transponder 18 transitions into, out of, or both into and out of one of the "in" detection regions 33*a*, 33*b*, 33*c*. The transponder locator 23*c* then determines 42 if the current smoothed geolocation of the transponder 18 is within any of the configured detection regions 32, 33.

To accomplish this, the transponder locator 23*c* determines 42*a* whether the location of the transponder 18 is within the X dimensional (down lane) bounds of the "in" detection regions 33*a*, 33*b*, 33*c*. Thus, when the current X geolocation (smoothed) of the transponder 18 is within ΔX (inclusive) of an "in" detection region 33*a*, 33*b*, 33*c* then that transponder 18 is within the X dimensional bounds of that "in" detection region 33*a*, 33*b*, 33*c*. Similarly, the transponder locator 23*c* determines 42*b* whether the location of the transponder 18 is within the Y dimensional (cross lane) bounds of the "in" detection regions 33*a*, 33*b*, 33*c*. That is, when the current Y geolocation (smoothed) of the transponder 18 is within ΔY (inclusive) of an "in" detection region 33*a*, 33*b*, 33*c*, that transponder 18 is within the bounds of one of the "in" detection regions 33*a*, 33*b*, 33*c*. Otherwise, the transponder 18 is considered to be in an "out" detection region 32*a*, 32*b*, 32*c*.

Then, the transponder locator 23*c* compares 43 the current location of the transponder 18 to the previous location of the transponder 18. If a change in the location of the transponder 18 occurs and one of the detection criteria has been met, a detection region report message is generated 44. The transponder locator 23*c* does not generate multiple detection region report messages while the transponder 18 remains in the current "in" detection region 33*a*, 33*b*, 33*c*.

The detection region report message is sent 45 to the application processor 23*b*, and if the transponder 18 moves out of any of the "in" detection regions 33*a*, 33*b*, 33*c*, the application processor 23*b* the communications link to that transponder 18. This minimizes the amount of processing and data transfer between the transponders 18 and the VRC reader 23*a* and application processor 23*b*.

For the purpose of completeness, the data definitions are presented below.

| Data item name | Composed of/Comments | Type |
|---|---|---|
| Detection criteria | Defines criteria for detection region notification. Criteria defines notification for both entry into and exit from detection region and in-bounds and out-of-bounds within that detection region | Data |
| Detection region | Defines a configured ΔX and a ΔY relative to the locator antenna in which a transponder meets detection criteria | Data |
| Smoothed geolocation | Corresponds to a best line fit of the last 6 non-smoothed geolocations that define the current X and Y location | Data |
| Track table | A list of track table entries | Store |
| Tracking zone | An area in which a locator is able to track a transponder | Data |
| Transponder | An in-vehicle device capable of two way communications with the VRC reader | Data |
| Transponder ID | A unique 32 bit number that identifies a transponder | Data |

Thus, the use of a plurality of detection regions that are used to control exchanges of data between a transponder in a vehicle and a reader that is part of a vehicle to roadside communications system used in an open road toll road revenue collection system in order to minimize data transfer therebetween has been disclosed. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A method of processing data transmissions between a transponder and a reader that minimizes data transmission therebetween while the transponder moves through a communication zone wherein data transmissions may occur, said method comprising the steps of:

defining a plurality of dimensionally programmable detection regions relative to the communication zone that comprise "in" detection regions and "out" detection regions, and detection criteria that indicate whether the transponder transitions into, out of, or both into and out of one of the "in" detection regions; to determining if a current geolocation of the transponder is within any of the detection regions;

comparing the current location of the transponder to a previous location of the transponder; and generating a detection region report message if a change in the location of the transponder occurs and one of the detection criteria has been met;

whereby processing and data transfer between the transponder and the reader is minimized.

2. The method of claim 1 further comprising the step of: transmitting the detection region report for processing.

3. The method of claim 1 wherein the step of determining if the current geolocation of the transponder is within any of the detection regions comprises the steps of:

determining whether the location of the transponder is within X dimensional bounds of the detection regions; and determining whether the location of the transponder is within Y dimensional bounds of the detection regions;

whereby the location of the transponder is within the "in" detection regions if it is within both X and Y dimensional bounds, and whereby the location of the transponder is within the "out" detection regions if it is within the X dimensional bounds and outside the Y dimensional bounds.

* * * * *